US005591932A

United States Patent [19]

Staiert et al.

[11] Patent Number: 5,591,932

[45] Date of Patent: Jan. 7, 1997

[54] BREAK ACTION CANNON

[75] Inventors: Richard W. Staiert, Coon Rapids; James E. Wildman, Plymouth, both of Minn.

[73] Assignee: FMC Corp., Chicago, Ill.

[21] Appl. No.: 239,779

[22] Filed: May 9, 1994

[51] Int. Cl.[6] ..... F41A 3/14; F41A 3/76

[52] U.S. Cl. ..... 89/33.03; 89/25; 89/45; 89/23; 42/10

[58] Field of Search ..... 42/10, 11, 12, 42/13, 8; 89/33.03, 33.05, 161, 45, 46, 47, 20.4, 25, 23

[56] References Cited

U.S. PATENT DOCUMENTS 377,924 2/1888 Brankston ..... 89/46
487,631 12/1892 Mercer ..... 89/45
2,865,255 12/1958 Marsh ..... 89/33.03
3,967,402 7/1976 Cooksey ..... 42/10
4,151,782 5/1979 Allen ..... 89/161

FOREIGN PATENT DOCUMENTS 5264 of 1878 United Kingdom ..... 89/45

*Primary Examiner*—Stephen M. Johnson

[57] ABSTRACT

The break action cannon invention disclosed herein enables weaponization and integration of complex fire control systems concurrent with projectile loading operations in a gun system such that superior firing cycle and efficient power and thermal management are achieved. A barrel is detachably shifted and tipped at an angle to accept a projectile while breech operations and other firing preparations proceed unencumbered.

9 Claims, 3 Drawing Sheets

BREAK ACTION CANNON

FIELD OF THE INVENTION

This invention relates to a device and method for a break action cannon to deal with problems which arise in the weaponization and integration of regenerative liquid propellant system relative to deploying projectiles through gun tubes. The present invention enables, inter alia, efficient power and thermal management, superior firing cycle and high structural efficiency per unit weight, by enabling isolative loading of the gun tube.

SUMMARY OF THE INVENTION

The break action cannon of the present invention provides a device and method for segregating the process of loading a projectile into the gun tube from breech operations without impacting other critical firing cycle functions. Heretofore, devices and methods for regenerative liquid propellant breech loading include either swinging the breech block or vertically sliding a breech block or translating rearward and lifting a breech block to thereby provide unimpeded access to the gun tube. However, moving a regenerative liquid propellant breech assembly generally requires large power supply, complex structures and multiple controls. Further, existing devices are not flexible to promote integration into a weapon platform. Particularly, existing devices and methods, require complex gun mount structures which undetermine firing time cycles and pose severe design restrictions.

The present invention provides significant advantages over the prior practice. It provides both a method and mechanism for concurrent projectile ram and propellant charge at a lower power requirement and reduced component size. Further, reductions in swept volume and appreciable reductions in inertial forces for breech opening are realized.

Primarily, one of the significant advantages proffered by the present invention includes simultaneous loading of a projectile into a gun tube while a propellant charge system is primed. The breech is opened and the barrel is detachably tipped at an angle to accept a projectile while the propellant supply system is revitalized as needed.

Specific advances, features and advantages of the present invention will become apparent upon examination of the following description and drawings dealing with several specific embodiments thereof.

DESCRIPTION OF THE PREFERRED EMBODIMENT

Figure 1:
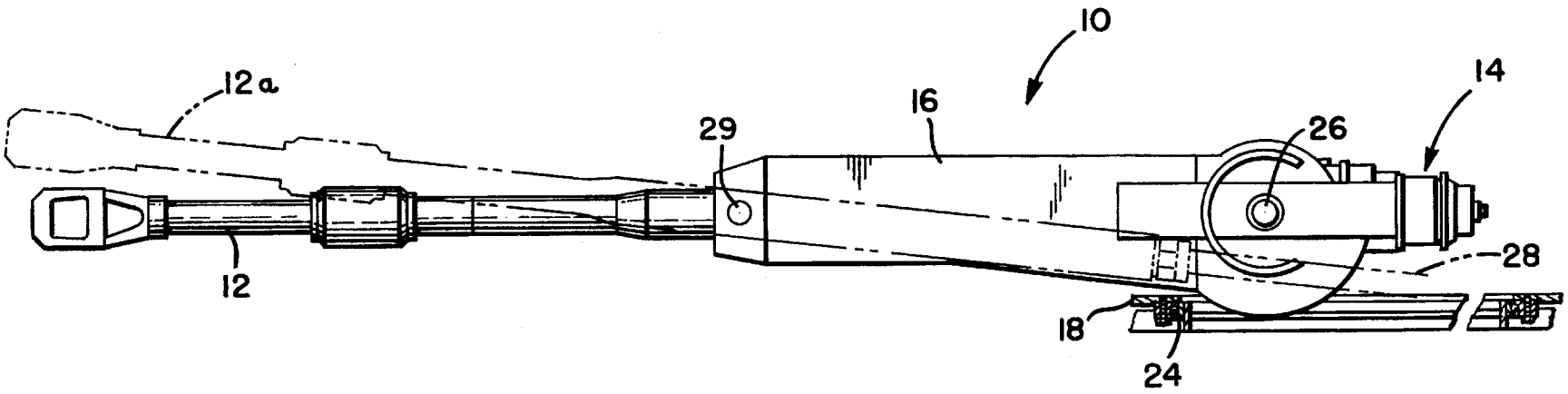
FIG. 1 is an assembly drawing of the present invention with the gun tube, shown in phantom, tipped at an angle to accept a projectile.

The preferred embodiment of the present invention is shown in FIG. 1. Gun assembly 10 comprises barrel 12 connected to the combustor and breech assembly 14. Cradle structure 16 encloses barrel 12 and breech assembly 14. Further, gun assembly 10 is supported at chassis deck 18. Deck 18 comprises bearings 24 to enable azimuth drive and trunnions 26 to enable elevation drive. The break action feature is depicted by barrel 12*a* which is rotatably tipped about fulcrum 29. Projectile feed path 28 is shown at breech end of cannon 12*a*.

Figure 2A:
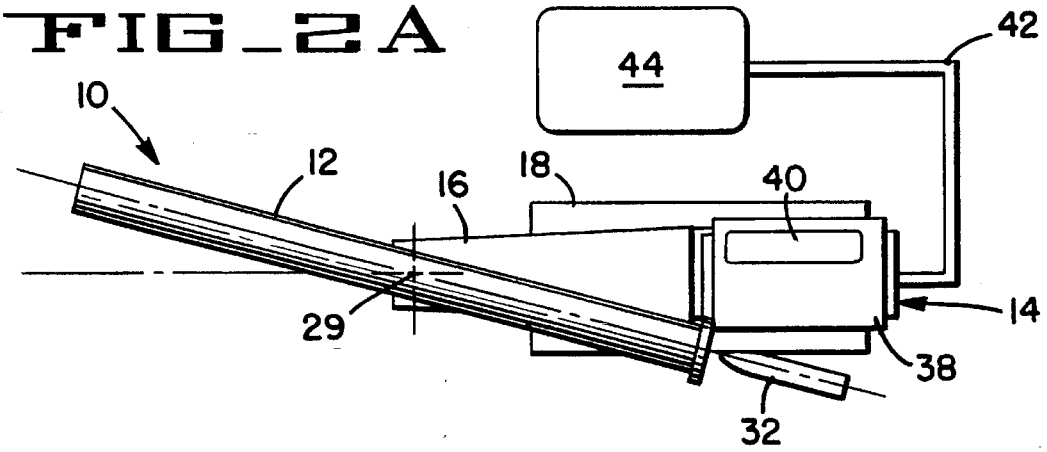
FIG. 2A is a block diagram showing the integration of the present invention with an internal and external propellant supply. The gun tube is shown in a disengaged position inclined to accept a projectile.

FIG. 2A is a block diagram depicting the integrability and flexibility of the present invention. In the preferred embodiment, a propellant charge system is integrated with the components of the present invention. In FIG. 2A, barrel 12 is shown in a tipped position, accepting projectile 32 via projectile path 28. Breech assembly 14 houses combustor compartment 38 and internal propellant supply 40. The component assembly is mounted on chassis or deck mount 18. Feed line 42 connects internal propellant supply 40 to external propellant storage 44. In the embodiment shown, breech assembly 14 is open.

Figure 2B:
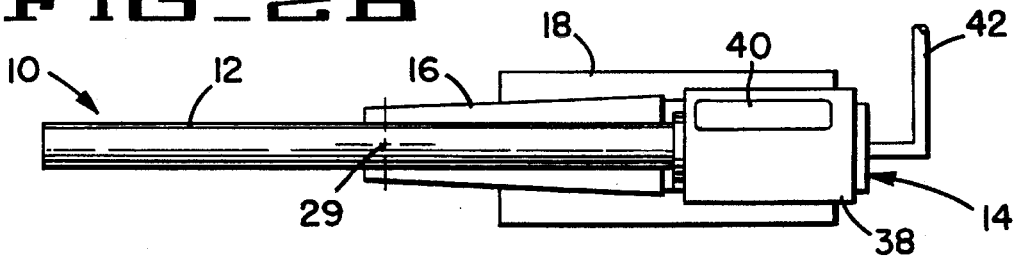
FIG. 2B is a block diagram showing the barrel coupled to a closed breech.

FIG. 2B is a block diagram showing barrel 12 in engagement with breech assembly 14. It depicts a sequential stage of FIG. 1 where breech assembly 14 is closed and the gun is ready to fire.

Figure 3A:
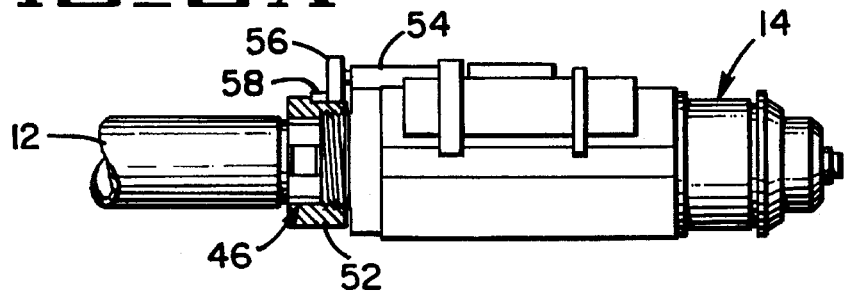
FIG. 3A is a detail drawing showing connections between the barrel and the breech assembly.

FIG. 3A shows the preferred embodiment connections between barrel 12 and breech assembly 14. Breech end of barrel 12 comprises machined surfaces and interupted threads 46 designed to provide a secure connection between barrel 12 and breech assembly 14. Barrel locking collar 52 connects barrel 12 with breech assembly 14. Further, actuator 54 is mounted on breech assembly 14 and operates barrel locking collar 52. Drive gear 56 is in mechanical contact with gear sector 58. Gear sector 58 is a part of barrel locking collar 52.

Figure 3B:
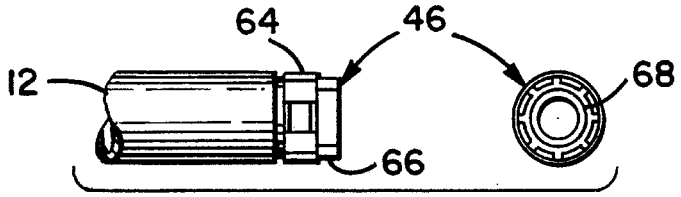
FIG. 3B is a detail drawing of a face seal and the breech end of the barrel.

FIG. 3B is a detail of machined surfaces 46 comprising the breech end of barrel 12. Interrupted lug threads 64 are formed adjacent to octagonal barrel pilot 66. Octagonal barrel pilot 66 comprises the breech end point of barrel 12 and transmits rifling torque to the breech and subsequently to the cradle and other supporting structure. Obturator 68 forms a face seal as shown.

Figure 4A:
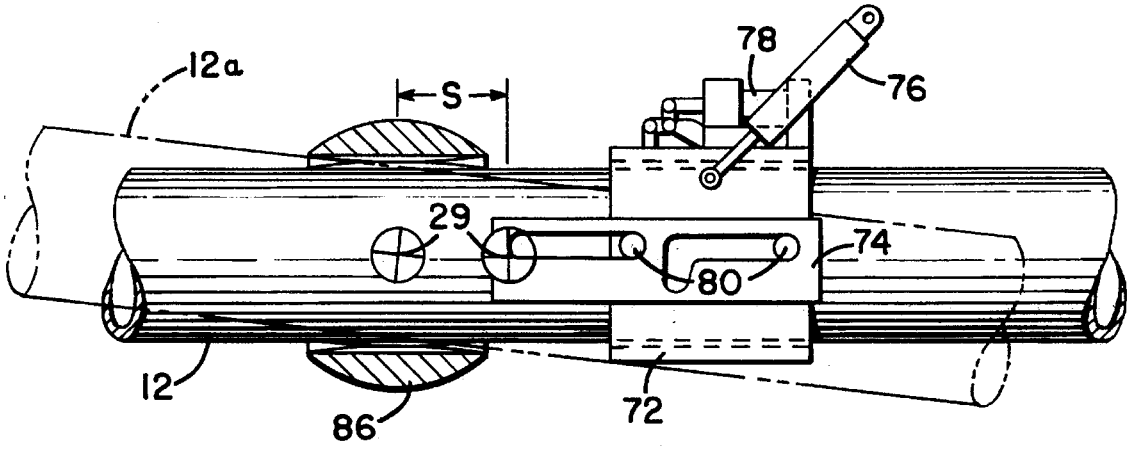
FIG. 4A is an enlarged elevation view of the barrel shifting and tipping mechanism.
Figure 4B:
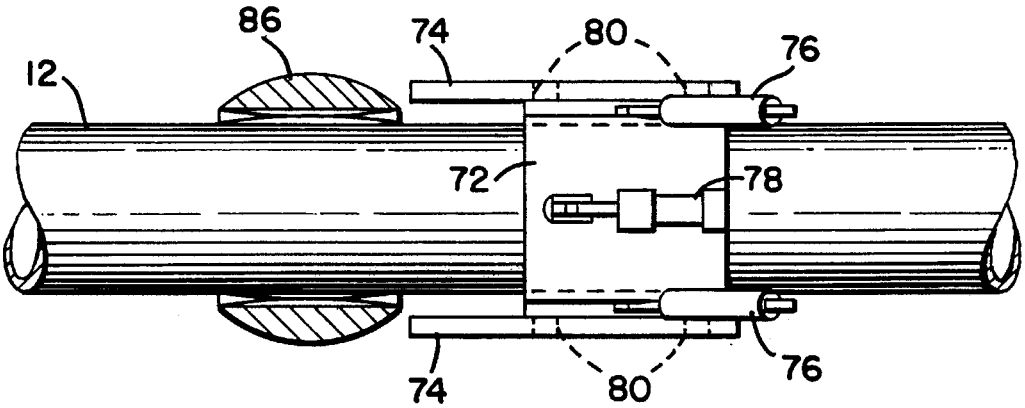
FIG. 4B is an enlarged plan view of the barrel shifting and tipping mechanism.

Referring now to FIGS. 4A and 4B, the barrel shifting and tipping mechanism is shown in elevation (FIG. 4A) and plan (FIG. 4B) views. In FIG. 4A, barrel 12 is shown with barrel shift collar 72. Barrel shift collar 72 mounts into cam plates 74 which are mounted to the cradle structure 16. Barrel shift actuator 76 is connected to barrel shift collar 72 at one end and cradle structure 16 (See FIG. 1) at the other. Barrel/Collar lock and actuator 78 is centrally disposed between barrel shift actuators 76 and is mounted on barrel shift collar 72. Cam follower 80 is attached to barrel shift collar 72. Barrel bearing 86 is mounted in cradle structure 16 (See FIG. 1). In FIG. 4A shifted barrel 12*a* is shown in broken lines indicating a tipping through a certain angle and a linear shift designated by "S".

The disclosure hereinabove relates to some of the most important structural features and organizations of the preferred embodiment. The functional and operational features are discussed hereinbelow.

Referring to FIG. 1, gun assembly 10 is shown wherein barrel 12 is normally engaged with breech assembly 14. Further, barrel 12*a* indicates the break action of the present invention. Here, the barrel is detached from breech assembly 14 and is ready to accept a projectile via projectile feed path 28. Some of the significant details of the break action, in the preferred embodiment, are discussed hereinbelow.

FIGS. 2A and 2B depict the operation of the break action cannon invention in conjunction with a regenerative liquid propellant system. In FIG. 2A, barrel 12 is tipped to accept projectile 32. In this set up, breech assembly 14 is open to refill/refurbish internal liquid propellant supply 40. The propellant mass is transmitted via feed line 42 which is connected to external propellant storage 44. As indicated in FIG. 2A, combustor compartment 38 in breech assembly 14, houses internal liquid propellant supply 40. When projectile 32 is loaded into barrel 12 and propellant is refurbished, breech assembly 14 is closed and barrel 12 engaged as shown in FIG. 2B.

In FIG. 3A, the connection between barrel 12 and breech assembly 14 is shown in detail. This connection is one of the significant aspects of the present invention and is therefore set forth in detail. The connection comprises, Barrel locking collar 52 and barrel lock/unlock actuator 54. Breech end of barrel 12 comprises machined surface 46 (See FIG. 3B). Machined surface 46 includes, interrupted lug threads 64 and octagonal barrel pilot 66. Further, obturator 68 forms a face seal. Barrel locking collar 52 includes a quarter turn interrupted lug internal threads to lock barrel 12 and breech assembly 14 for firing. Further, the connection between barrel locking collar 52 and breech assembly 12 comprises obturator 68 to thereby seal combustion gases. More particularly, interrupted lug threads 64 and octagonal barrel pilot 66 form a snug fit between barrel 12 and breech assembly 14 such that torque loads due to barrel 12 rifling are transferred. Heretofore, threaded connections are used between a barrel and a breech block to absorb firing pressures and resultant stresses. However, in the preferred embodiment of the present invention, the interrupted lug threads 64 provide a structural connection with barrel locking collar 52. Octagonal barrel pilot 66 are designed both to transmit rifling torque to breech assembly 14 and trunions 26 (see FIG. 1) and further enable a quick disconnect to promote the break action operation. Barrel lock/unlock actuator 54 is attached to cradle 16 (See FIG. 1). Drive gear 56 provides a positive static lock position and extends forward and rotates barrel locking collar 52 to either unlock or lock barrel 12 and breech assembly 14. Gear sector 58 is part of barrel locking collar 52 and is operated by drive gear 56.

Accordingly, when the break action of barrel 12 is initiated, barrel lock/unlock actuator 54 starts drive gear 56. Thereafter, drive gear 56 urges gear sector 58 and barrel locking collar 52 is rotated through a quarter turn to detach barrel 12 at interrupted lug threads 64. This retains barrel locking collar 52 secured to breech assembly 14 while releasing barrel 12. Particularly, obturator 68 is uniquely adaptable to repeated connection and disconnection cycles of barrel 12 and is replaceable as needed to maintain a positive pressure in the gun chamber and barrel 12 and to seal combustion gases therein.

During the detachment of barrel 12 from breech assembly 14, in the manner discussed hereinabove, barrel shift actuator 76 extends forward to drive barrel shift collar 72 forward. Cam plates 74, which are attached to cradle 16, guide the fore shift and tipping of barrel 12. Barrel/collar lock and actuator 78 locks barrel 12 to barrel shift collar 72 so they can together shift forward and tip. Barrel shift collar 72 mounts into cam plates 74 and maintains a controlled movement in the cam path. Cam followers 80 are attached to barrel shift collar 72 and are guided in the cradle mounted cam plates 74. When barrel 12 is thus shifted forward barrel bearing 86 guides barrel 12 and allows it to tip for projectile loading. One of the unique aspects of the break action cannon invention is the forward shifting of barrel 12 to provide tipping in order to create swing space and volume for loading projectiles without interfering with breech operations. The present invention accomplishes this advantage of employing simple and yet efficient mechanisms. More particularly, when barrel 12 is shifted a distance "S" forward, barrel bearing 86 is cooperation with cam plates 74 and cam followers 80 tip barrel 12 thus implementing the break action.

Barrel 12 is returned back to its original aligned position relative to breech assembly 14 when barrel shift actuator 76 is retracted and drives barrel shift collar 72 backwards and as well pulls barrel 12 via cam followers 80 which are guided in cam plates 74. Cam plates 74 thus guide the backward shift, and pull barrel 12 back up from its tipped position. Barrel/collar lock and actuator 78 locks barrel 12 to barrel shift collar 72 so that barrel 12 can shift backwards and return back to a non-inclined position. Thus, the forward and backward movements of barrel/collar lock and actuator 78 enable a forward shift or a backward pull of barrel 12 as indicated.

Accordingly, when breech end of barrel 12 is pulled into barrel locking collar 52, drive gear 56 extends forward and rotates barrel locking collar 52 to lock barrel 12 to breech assembly 14 thereby completing a cycle of the break action cannon.

While a preferred embodiment of the break action cannon has been shown and described, it will be appreciated that various changes and modifications may be made therein without departing from the spirit of the invention as defined by the scope of the appended claims.

What is claimed is:

1. A device for separating a gun barrel, having a muzzle end and a breech end, from a breech block and combuster compartment to simultaneously ram a projectile into said barrel comprising:

a mechanism for removably attaching the barrel to the breech block including:

a barrel locking collar and actuator;

a machined surface of the barrel at said breech end; and said barrel locking collar threadably mated to said machined surface of the barrel to thereby lock the barrel;

a mechanism for shifting the barrel forward including:

a barrel shift collar; and an actuator to drive said barrel shift collar;

a mechanism for orienting the barrel including:

cam plates cradle; and said cam plates attached to said cradle to fore shift and tip said barrel; and an obturator face seal disposed between said barrel locking collar and said breach end to positively seal combustion gases therein.

2. A device according to claim 1 wherein said barrel locking collar includes a quarter turn interrupted lug internal threads to lock said barrel and said breech block.

3. A device according to claim 1 wherein said machined surface includes interrupted lug threads and octagon barrel pilot.

4. A device according to claim 1 further including said barrel shift collar mounted into said cam plates to maintain a controlled movement in a path of said cam plates.

5. A device according to claim 1 further including a barrel bearing which cooperates with said cam plates and cam followers to tip said barrel.

6. A device according to claim 1 further including a drive gear which extends forward and rotates said barrel locking collar to lock said barrel to said breech block and combuster compartment.

7. A method for separating a gun barrel from a breech block and a combuster compartment to ram a projectile into the gun barrel comprising the steps of:

detaching said barrel at front of said combuster compartment;

pulling the barrel forward and simultaneously tipping the barrel; and ramming the projectile into the gun barrel.

8. A method according to claim 7 wherein said detaching the barrel from the breech block includes pushing the barrel forward.

9. A method according to claim 7 wherein said tipping of the barrel includes positioning the barrel at an angle to align a ram to load said projectile.

* * * * *